US006136460A

United States Patent [19]

Chen et al.

[11] Patent Number: 6,136,460

[45] Date of Patent: Oct. 24, 2000

[54] TIN COATINGS INCORPORATING SELECTED ELEMENTAL ADDITIONS TO REDUCE DISCOLORATION

[75] Inventors: Szuchain Chen, Orange; Julius Fister, Hamden, both of Conn.; Dennis Brauer, Brighton, Ill.; Arvind Parthasarathi, North Branford; Christopher Laurello, Guilford, both of Conn.

[73] Assignee: Olin Corporation, New Haven, Conn.

[21] Appl. No.: 09/054,899

[22] Filed: Apr. 3, 1998

[51] Int. Cl.[7] ..... B32B 19/00; B32B 9/00

[52] U.S. Cl. ..... 428/699; 428/212; 428/547; 428/646; 428/643; 428/644; 428/648

[58] Field of Search ..... 428/212, 547, 428/646, 643–644, 648, 699

[56] References Cited

U.S. PATENT DOCUMENTS

| | | | |
|---|---|---|---|
| 3,767,391 | 10/1973 | Tucillo . | |
| 3,940,303 | 2/1976 | Caule | 156/316 |
| 4,113,475 | 9/1978 | Smith . | |
| 4,204,883 | 5/1980 | Smith . | |
| 4,255,191 | 3/1981 | Kropp . | |
| 4,468,293 | 8/1984 | Polan et al. | 204/27 |
| 4,490,218 | 12/1984 | Kadija . | |
| 4,493,736 | 1/1985 | Adams . | |
| 4,663,245 | 5/1987 | Yoshida . | |
| 4,917,967 | 4/1990 | Cupolo et al. | 428/669 |
| 5,028,492 | 7/1991 | Guenin | 428/614 |
| 5,300,158 | 4/1994 | Chen . | |
| 5,332,486 | 7/1994 | DiFranco . | |
| 5,343,073 | 8/1994 | Parthasarathi et al. | 257/666 |

FOREIGN PATENT DOCUMENTS 3-239535 10/1991 Japan .

OTHER PUBLICATIONS

S. C. Britton and K. Bright, "An Examination of Oxide Films on Tin and Tinplate", Metallurgia, Oct., 1957, pp. 163–168.

*Primary Examiner*—William Krynski
*Assistant Examiner*—B. Shewareged
*Attorney, Agent, or Firm*—Todd E. Garabedian; Wiggin & Dana

[57] ABSTRACT

A method of introducing an anti-tarnish agent into the matrix of a tin coating to reduce oxidation and/or yellowing of the tin coating. The agent is preferably zinc, indium or phosphorous and can be deposited in a molten form to alloy with the existing tin coating. Alternatively, the existing tin coating may be exposed to a chemical bath including the agent and later heated to reflow the tin coating and agent thereby incorporating the agent into the matrix of the tin coating.

28 Claims, 2 Drawing Sheets

TIN COATINGS INCORPORATING SELECTED ELEMENTAL ADDITIONS TO REDUCE DISCOLORATION

BACKGROUND OF THE INVENTION

1. Field of the Invention

This invention relates to a method for producing a tin coating that resists oxidizing. More particularly, this invention relates to a method for introducing selected additions of a material into a tin coating that reduce discoloration of the tin coating.

2. Background of the Invention

Tin coatings are frequently applied to copper alloy devices such as leadframes and electrical connectors. One function of the tin coating is to prevent copper alloy surfaces from oxidizing or tarnishing. A tarnish-free surface has lower electrical contact resistance than an oxide coated surface and also has better solderability.

Under conditions such as elevated temperatures in air or other oxygen containing atmospheres, tin coatings have a tendency to oxidize, producing oxide films that discolor the surface of the tin coatings with a yellowish color. Although the oxide film is typically only about 50–200 Angstroms in thickness, the surface of the tin may turn a yellow color, which many consumers consider unacceptable.

Under some conditions, such as elevated temperature environments, the oxidized growth may attain a thickness that degrades the contact resistance of a coated electrical terminal.

There have been attempts to address some of these shortcomings. These prior attempts failed to provide an efficient way to prevent oxide growth on a tin coating.

A publication entitled, "An Examination of Oxide Films on Tin and Tin Plate", by S. C. Britton and K. Bright discloses that the addition of small amounts of phosphorous, indium or zinc to tin prevents the formation of color films when the metal is heated. Although this article recognizes the need to prevent oxidation of tin, it does not disclose an efficient method to introduce oxide resisting elements into the tin coating such that these elements have an increased concentration at the surface of the tin that is exposed to ambient air.

Japanese Kokai No. 3(1991)-239,353 published Oct. 24, 1991, discloses a copper leadframe for semiconductor devices. This reference describes placing zinc between a copper leadframe and a tin coating. The zinc layer is introduced to prevent diffusion between the tin coating and the copper leadframe. This reference also fails to disclose an efficient method for applying selected oxide resistant elements into a surface of a tin layer exposed to ambient air.

As can be seen from the illustrative background discussed above, there is a need for a method to provide an anti-tarnish, oxide resistant, agent such as indium, phosphorous or zinc into tin coatings in order to provide protection against yellowing in elevated temperature environments, such as encountered by electrical terminals connected to sources of high voltage and current and automotive connectors. The present invention provides a solution to that need in the form of a procedure to add material to tin coatings to form a composite coating of tin and an anti-tarnish agent that resists oxidation.

BRIEF SUMMARY OF THE INVENTION

It is one object of the present invention to provide a method for introducing a material into a tin coating of an article. Accordingly, one embodiment is a method comprising the steps of:

depositing a tin base coating on the article;

immersing the article with the tin coating in a chemical solution, said chemical solution containing a compound effective to resist the formation of a yellow tin oxide compound;

removing said article from said chemical solution and drying whereby a layer of said compound coats exterior surfaces of said tin coating.

A second embodiment of the present invention is to provide a method for introducing an anti-tarnish agent into a tin coating on a strip. This method includes immersing an anode into an electrolyte bath, said anode formed from an alloy of tin and an effective anti-tarnishing agent;

immersing an article for receiving said alloy into said electrolyte; and impressing a current between said anode and said article effective for said article to receive a coating of tin and said anti-tarnishing agent.

A third embodiment of the present invention is to provide a method for introducing a material into a tin coating of an article. This method comprises depositing a tin base coating having a thickness of between about 40–400 microinches on an article;

electroplating or vapor depositing a layer of anti-tarnish agent between approximately 5 Å–2000 Å thick onto said tin base coating; and heating a surface of the article to a temperature sufficient to incorporate the layer of anti-tarnish agent into the tin coating thereby forming a reflow layer.

A fourth embodiment of the present invention is a composite coating for an object comprising:

a substrate;

a tin base layer having a thickness between approximately 40–400 microinches thick deposited on one or more surfaces of said substrate; and an anti-tarnishing agent layer having a thickness between approximately 5 Å–2000 Å diffused into said tin base layer, said anti-tarnishing layer having a first surface and a second surface, said second surface proximate said tin base layer;

wherein said anti-tarnish agent layer has a higher concentration of anti-tarnishing agent at said first surface than at said second surface.

A fifth embodiment is directed to a method for enhancing the tarnish resistance of an object comprising the steps of:

providing a molten bath containing tin and an anti-tarnish agent;

immersing the object into the bath for a period of time sufficient to coat at least one surface of the object with a coating from the molten bath; and processing the coating.

DETAILED DESCRIPTION OF THE INVENTION

Figure 1:
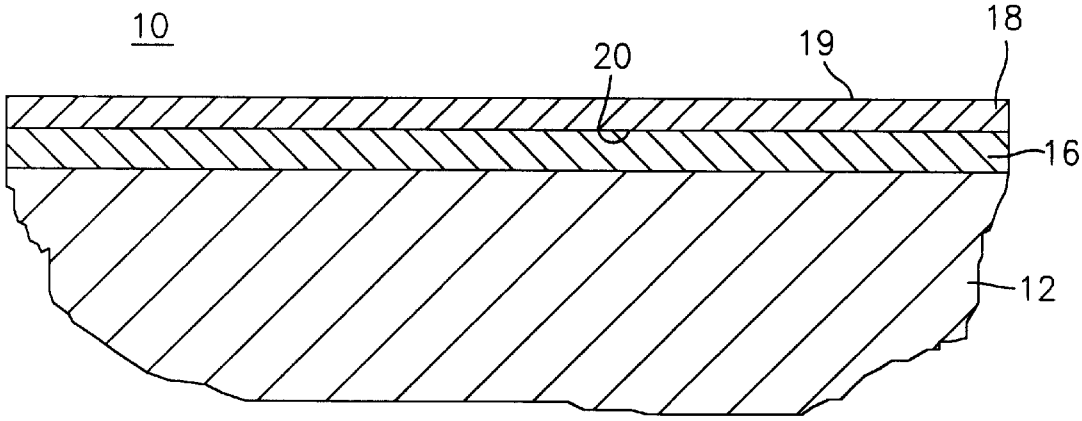
FIG. 1 shows a cross-sectional representation of a composite substrate in accordance with one embodiment of the present invention.

The present invention provides a method that reduces oxidation on a tin coating by adding an anti-tarnish agent, for example zinc, indium, phosphorous or mixtures thereof, to the matrix of the tin coating. The present invention also describes a composite coating of tin and an anti-tarnish agent.

An article, such as a copper or copper-base alloy electrical connector or leadframe, is often coated with a tin or tin base coating (The term "base" is intended to convey that the alloy contains at least 50%, by weight, of the specified element. Tin or tin base coatings will be referred to herein as tin coatings) over a surface through conventional methods such as electroplating, hot dipping, electroless chemical deposition, vapor deposition or cladding.

One electroplating method involves using a tin ion containing electrolyte to deposit a tin coating on an article. Examples of such baths include fluoborate, methanesulfonic, sulfate and stannate. One exemplary tin electrolyte contains between 10 g/l and 50 g/l tin and between 30 g/l and 70 g/l sulfuric acid. The bath is typically acidic and operated at a nominal temperature of 20–40° C. at a current density of about 30 amps per square foot. The bath will deposit about 50 microinches of tin in 1 minute. Examples of copper base articles that are coated with tin are leadframes, electrical connectors, and other substrates.

The tin coating on the article can be bright or matte. A bright finish on the tin coating may be achieved by adding an organic material, for example, polyethylene glycol, to the tin bath. The addition of such an organic material produces a tin coating with a smooth, hard surface.

Alternatively, a matte finish on the tin coating may be produced. This is a semi-bright, satin finish that is typically thicker than the bright finish. It has the advantage that it has a longer operational life and can be used in heavy-duty applications.

The tin coating may also be produced by HALT process (hot air level tin process). This process involves dipping an article, such as a leadframe or other strip of material into a molten tin bath and then directing jets of high velocity hot air across major surfaces of the article or strip as the strip is removed from the molten tin bath. The hot air levels the tin coating at a desired thickness such as between 40 to 400 microinches thick.

In addition to the HALT process, there is also a mechanical wipe process that will produce a uniform tin coating on an article. The mechanical wipe process involves dipping an article, or strip, into a molten tin bath and, upon removal of the article from the bath, physically wiping the article to produce a layer of tin on the article. The thickness of the tin layer is a function of how much tin is wiped from the surface. The thickness of the tin coating for the present invention can be approximately 20–1000 microinches, with a preferred thickness of approximately 40–400 microinches and a most preferred thickness of 150–300 microinches.

During the formation of the tin coating on an article, an anti-tarnish agent to reduce oxidation of the tin coating can be added to the molten tin bath and thereby alloy with the tin. The combination of tin and the anti-tarnish agent form a composite layer that may be deposited on a leadframe. The anti-tarnish agent is introduced into the tin matrix and therefore will not chip, peel or erode off the tin. The molten tin bath used to produce this composite layer is suitably at least 50% by weight tin with not more than 50% by weight other materials including the anti-tarnish agent and typically 99% to 99.99% tin by weight with 1% to 0.01% by weight of any compound that dissolves in molten tin and is effective to provide tarnish resistance. Preferred are zinc (Zn), indium (In), phosphorous (P) and mixtures thereof.

Another possible tin coating is a tin-lead solder coating. This tin-lead coating can have from 5% to 95% by weight tin and the balance is lead. Preferably, the coating has 25% to 75% by weight tin and the remainder lead. A well-known tin-lead solder has 60% by weight tin and 40% by weight lead, and yet another tin-lead coating has 63% by weight tin and 37% by weight lead.

An article, such as a strip of material, leadframe, electrical connector or substrate can be immersed in the molten bath having any temperature effective to melt the tin/anti-tarnish agent composition. Preferably, the bath temperature is between 235° C. and 340° C. The immersion time is a period of time effective for the molten material to coat the article, which is typically between 1 and 30 seconds. After a sufficient period of time has elapsed, the article can be removed from the bath and be further processed.

The processing can be any series of steps that produce a desired coating thickness on the article. For example, the mechanical wipe process or the HALT processes, as described above, are two processes that can be used to produce a desired coating.

A desired thickness of anti-tarnish agent layer could be for example between 5 Å and 2100 Å, preferably between 15 Å and 500 Å and most preferred between 25 Å and 200 Å.

The anti-tarnish agent, which is a material to reduce oxidation of the tin coating, may be added to the molten tin bath in the form of ingots.

Thus, the above description discloses procedures to produce a composite tin and anti-tarnish layer that can be deposited on a leadframe. Alternatively, the anti-tarnish agent may be added to the tin after the coating has formed on an article. This subsequent addition reduces effects of oxidation, which is typically visible as a yellowing of the tin coating. This additional treatment could be exposing the tin coating to an anti-tarnish agent, then rapidly heating the surface of the tin coating exposed to the anti-tarnish agent thereby reflowing the surface of the tin coating and alloying the agent into the tin coating. This reflow temperature can typically range from 235° C. to 350° C. for a tin coating.

Alternatively, a coating that is 60% by weight tin and 40% by weight lead will have a reflow temperature range from 195° to 350° C.

One method of exposure can be accomplished by immersing the article in a chemical solution, containing the anti-tarnish agent, for a period of time effective to coat the article with the chemical solution. Upon removing the article, a residual layer of chemical will remain on the article. A preferred concentration of anti-tarnish agent on the article is between 0.01% and 1% by weight. The article can then be heated to a temperature sufficient to melt the surface of the tin coating i.e., its reflow temperature. Heating is by any suitable method, such as in a hydrocarbon type reducing atmosphere; in some other suitable atmosphere such as air, nitrogen or other inert gas; an induction furnace; infrared heating; or immersion in hot oil. Upon heating the article past this temperature, the residual chemical is incorporated into the matrix of the tin coating. Typically, the entire tin coating is reflowed thereby causing the residual chemical to be diffused into the tin coating. However, any portion of the tin coating may be heated to the reflow temperature thereby diffusing any portion of the residual chemical into the tin coating.

The reflowed layer will typically have a higher concentration of residual chemical at an exterior surface of the tin coating than at the interface between the tin coating and the substrate. This gradient is a result of the residual chemical being on the outer surface of the tin coating at the time of reflow. The reflow process causes the residual chemical to be incorporated into the tin matrix, but the tin layer, after reflow, does not necessarily have a uniform concentration of residual chemical.

The thickness of the reflowed layer is typically greater than the thickness of the residual layer since the reflow process causes the residual chemical to alloy with a portion of the tin coating to form the reflow layer. The reflow layer can be as thick as the combined thickness of the residual layer and the tin coating.

A second way to form the composite coating is to expose the tin coating to a material such as zinc or indium by electroplating the material to the tin coating by immersing a substrate i.e. leadframe, in a bath. An example of a zinc bath used to apply a zinc layer to a tin coating is 0.1 to 200 g/l of zinc chloride in an aqueous solution having a pH between 1 and 5. If an indium layer is desired on the tin coating, an indium bath having 0.1 to 200 g/l of indium in an aqueous solution having a pH between 1 and 5 may be used to provide an indium layer on the tin coating. The surface of the tin coating is heated to a temperature sufficient to reflow the tin and incorporate the electroplated material into the tin matrix. The tin coating typically has a matte finish in reflow situations since the matte finish has a preferred thickness. Typically a temperature between 235° C. and 350° C. will cause the tin coating to reflow.

In another embodiment of the invention, an anode having tin and an anti-tarnish agent is placed in an electrolyte bath solution with a cathode. A composite coating of the tin and the anti-tarnish agent is plated to the cathode. An anode having 90% to 99.98% by weight tin and 10% to 0.02% by weight zinc is one example of an anode. A suitable electrolyte bath for use with the composite anode may have 10 g/l to 50 g/l by weight zinc as zinc sulfate salt or any other soluble zinc salt and 10 g/l to 50 g/l tin in a tin sulfate bath.

The cathode may be for example, a strip or article that has a negative electrical charge in relation to that of the anode and as a result will receive a deposition of approximately the same compositions as the anode. Conventional tin anodes are replaced with anodes containing tin that is alloyed with zinc, indium, or another desired material. During the plating process, the element(s) added to the tin enter the tin bath and plate onto the strip or article, causing the formation of a tin coating doped with the desired elements on the article. Electrical current is applied to the electrolyte bath by a constant current source. The applied current is preferably a constant d.c. current, having a magnitude typically between 20 and 60 Amps/square foot. The dwell time for the anode and cathode in the electrolyte bath is typically between 20 and 100 seconds. Appropriate complexing agents may be added to the bath to ensure that the tin and the additional element(s) electroplate in the preferred composition(s).

In another embodiment, tin coated strips or articles can also be made using any vapor deposition or chemical deposition methods. In these methods, the desired tin alloy, containing for example indium, zinc or phosphorous, can be made by depositing from a tin alloy of the preferred composition or by introducing a gaseous mixture of tin and the preferred metal species into a chemical vapor deposition chamber.

In still another embodiment, thin films of chromium and zinc are plated to a tin coating to prevent oxidation of the tin coating. This film of zinc and chromium is deposited on a tin coating by immersing an article with a tin coating into a bath containing zinc and chromium.

The advantages of the invention will be better understood by the Example that follows.

EXAMPLE

Table 1 shows results of dipping an article with a tin coating into a chemical solution and then reflowing the surface of the tin coating.

A copper alloy, C194 alloy substrate (having the nominal composition, by weight, of 2.1 to 2.6 Fe, 0.05 to 0.20 Zn, 0.015 to 0.15 P, 0.03 Pb max, 0.03 Sn max, 0.15 max other (total), bal Cu) was electrocleaned in an aqueous alkaline solution having a concentration of about 30 g/l of sodium hydroxide for approximately 40 seconds at a current density of about 30 mA/cm$^2$.

The substrate was then rinsed in deionized water and a tin coating was deposited utilizing electroplating in an acidic sulfate solution having between 30 g/l and 50 g/l tin at an electric current density of about 30 mA/cm$^2$ for about 55 seconds to obtain a layer of tin about 50 microinches thick on the substrate.

The substrate was rinsed again in deionized water, and then dipped into an aqueous solution of zinc chloride having a zinc ion content of between 0.1 g/l–5.0 g/l, as specified in Table 1. It should also be noted that the additional benefits of the zinc chloride dip is to brighten the surface of the substrate, a cosmetically appealing result.

After dipping, the substrate was dried either in air or in a furnace, but not rinsed, leaving a residual film of zinc chloride on the tin coating. This residual film on the tin coating had a concentration of zinc chloride of between about 0.01% and 1.0% and the residual film thickness was between about 5 Angstroms to about 2000 Angstroms thick.

The substrate was then exposed to heat in an air atmosphere such that the tin melted and the tin surface reflowed. During this reflow, the residual zinc alloyed with the tin.

As can be seen from Table 1, the concentrations of the zinc chloride ($ZnCl_2$) solutions are 0.1 g/l, 0.5 g/l, 1 g/l and 5 g/l.

TABLE 1

| Time (sec) at 350° C. | Standard* | 0.1 g/l $ZnCl_2$ | 0.5 g/l $Zn/Cl_2$ | 1 g/l $ZnCl_2$ | 5 g/l $ZnCl_2$ |
|---|---|---|---|---|---|
| 5 | bright | bright | bright | bright | bright |
| 15 | tarnished | bright | bright | bright | bright |
| 25 | tarnished | bright | bright | lightly tarnished | lightly tarnished |
| 35 | tarnished | bright | bright | lightly tarnished | lightly tarnished |
| 120 | — | lightly tarnished | lightly tarnished | — | — |

Table 1, shows qualitative results of samples having a composite tin and zinc coating and samples with a "standard" coating, which was a tin coating without the addition of zinc. The composite coatings were produced by immersing tin coated substrates in aqueous zinc chloride solutions having concentrations from 0.1 g/l to 5 g/l. The samples were all exposed to a hot plate at 350° C. to accelerate the tarnishing of the coatings. The time of exposure varied from 5 seconds to 120 seconds. After the particular exposure time elapsed the samples were removed from the heat and examined. The "bright" finishes were the most reflective, and did show any yellowing or discoloration. The "lightly tarnished" finishes were not as reflective as the bright finishes and showed very slight discoloration in the coating. The "tarnished" finishes were yellow and/or light brown in color.

FIG. 1 shows a cross-sectional view of a composite substrate with an oxide resistant tin coating. The composite substrate 10 includes a substrate 12, such as a copper or copper base alloy leadframe with a tin coating 16. The tin coating 16 has an anti-tarnish coating 18 alloyed to the tin coating 16 as a result of reflowing. The anti-tarnish layer may include anti-tarnish agents such as zinc, indium, phosphorous or alloys or mixtures thereof. The anti-tarnish layer 18 has a higher concentration of anti-tarnish agents at a first surface of the anti-tarnish layer 19 than at the interface with the tin coating (second surface) 20. This increased concentration at the first surface 19 is a result of the reflow process that causes the anti-tarnish agent that was on the surface of the tin coating 16 to be diffused into the tin coating. This reflowing does not homogeneously mix the tin and the anti-tarnish agents, but rather results in a concentration gradient from the first surface 19 of the anti-tarnish layer 18 to the second surface 20, where the anti-tarnish layer 18 interfaces with the tin coating 16.

Figure 2:
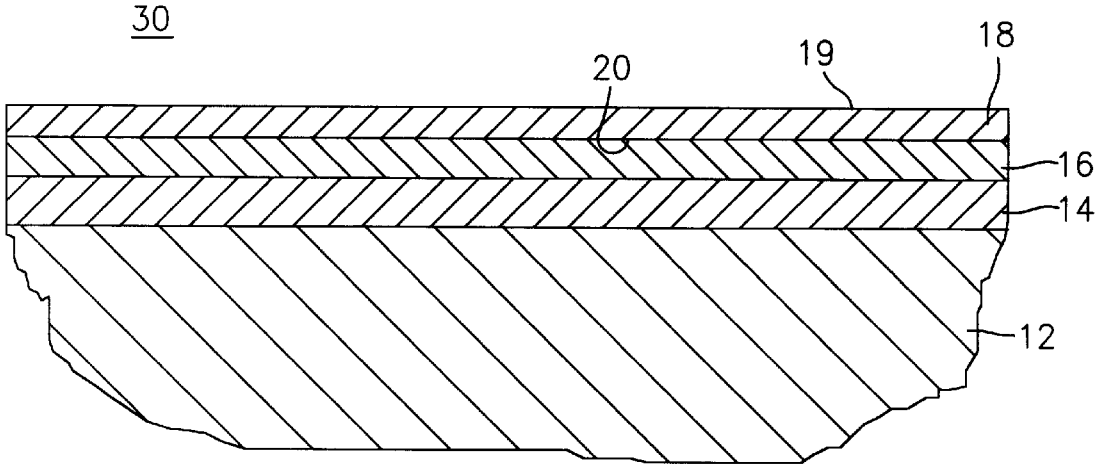
FIG. 2 shows a cross-sectional representation of a composite substrate in accordance with another embodiment of the present invention.

FIG. 2 shows a cross-sectional view of a composite substrate 30. The substrate 30 is similar to substrate 10 except that an intermediate layer 14 disposed between the substrate 12 and the tin coating 16. This intermediate layer 14 reduces the rate of intermetallic formation between the substrate 12 and the tin coating 16. The intermediate layer 14 may be applied to either the entire substrate 12 or any portion thereof, by any suitable means including hot dipping, cladding or electroplating. The intermediate layer 14 may also be formed by plating alternating layers of different metals and then diffusing the layers to form a desired alloy.

The intermediate layer 14 enables a sufficient thickness of free tin to remain on the surface of the substrate 12 and thus maintain the integrity of the tin coating 16. The intermediate layer may include iron, cobalt, nickel, copper, tin or alloys or mixtures thereof. One example is tin and a 10% to 70% by weight nickel layer with a thickness of from 0.2 microns to 10% of the total composite tin and nickel layer thickness. Intermediate layers, as more fully disclosed in U.S. Pat. No. 5,780,172 issued Jul. 14, 1998, which is incorporated by reference in its entirety herein, may also be utilized.

Additionally, a composite tin coating can be produced by adding compounds as particulate to a tin base matrix. The components may be uniformly dispersed polymers such as polyimide, polyamide, and polytetrafluoroethylene ("TEFLON" is a trademark of DuPont Corporation of Wilmington, Del.). The components reduce friction without significantly increasing contact resistance. These components can range in size from about 0.5 microns to 3 microns. Other examples of such components include silicon carbide, aluminum oxide, tungsten carbide, molybdenum and disulfide. Composite coatings, as more fully disclosed in Guenin, U.S. Pat. No. 5,028,492 that is incorporated by reference in its entirety herein, may also be utilized.

The anti-tarnish agent layer 18 is then applied into the tin coating 16 as described above.

Figure 3:
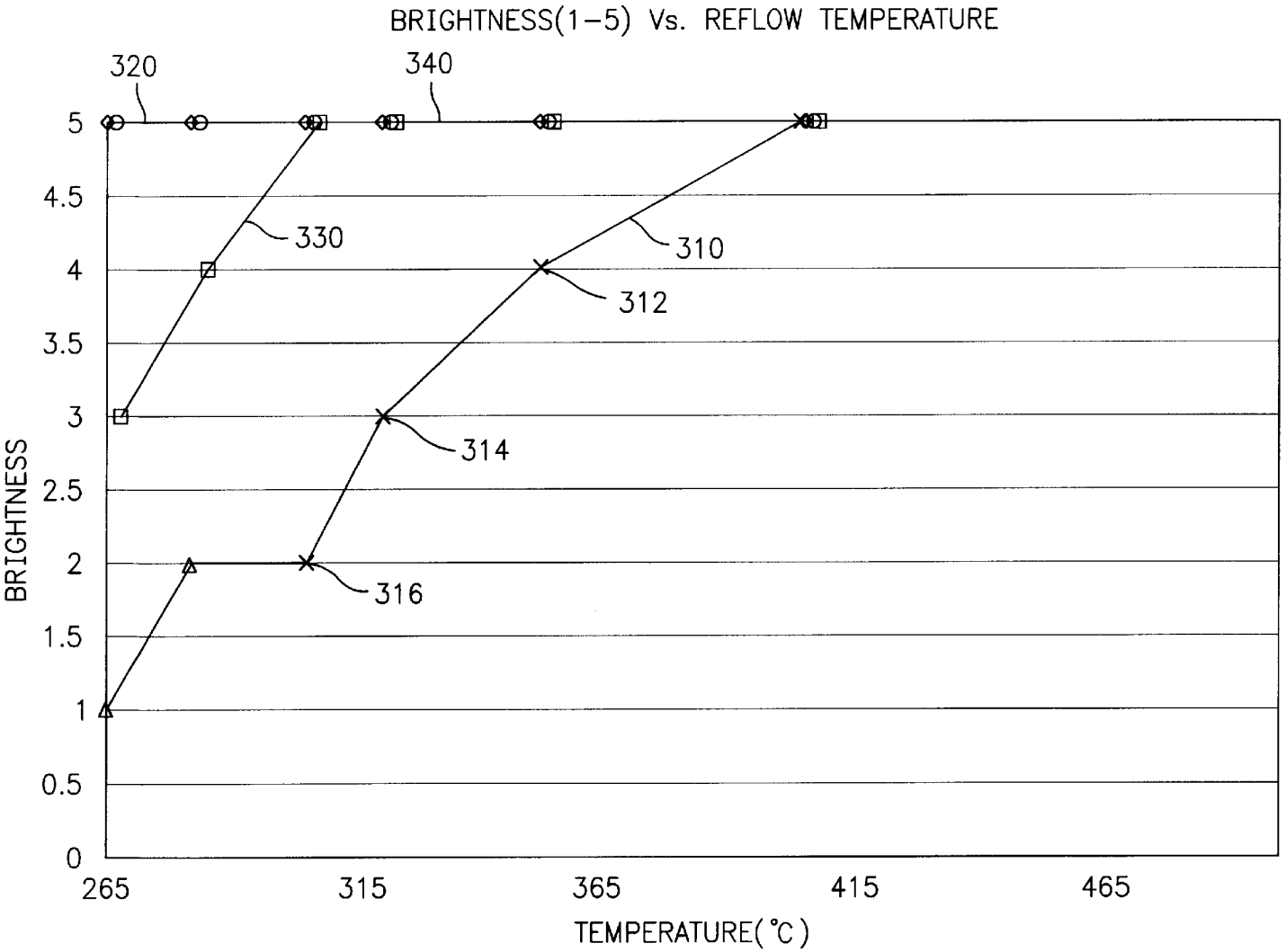
FIG. 3 graphically illustrates the reflow brightening temperatures as a function of processing.

FIG. 3 is a chart of experimental data tabulated in Table 2 that shows the effects of immersing the tin coated substrate in an anti-tarnish agent of the invention. Referring to Table 2 and to FIG. 3, reference line 310 refers to Sample A, reference line 320 refers to Sample B, reference line 330 refers to Sample C and reference line 340 refers to Sample D of the invention.

The samples were produced using tin coated copper alloy, C521 substrates, which were dipped in an aqueous solution of zinc chloride having a zinc ion content of 0.5 g/l. A barrier layer consisting of 10 microinches of copper and 10 microinches of nickel was disposed between the substrate and the tin coating for Samples A and B; no barrier layer was utilized with Samples C and D. Samples B and D were then treated with an anti-tarnish agent as described in the present invention. One member of each of Samples A–D was then heated to a temperature as specified in Table 2 and retained at temperature for two seconds in an air atmosphere. After heating, the finish of each sample was visually examined and assigned a number. A number "5" was a bright finish and a number "1" was a dull, cloudy finish.

TABLE 2

| Temp (C.) | A | B | C | D |
|---|---|---|---|---|
| 265 | 1 | 5 | 3 | 5 |
| 282 | 2 | 5 | 4 | 5 |
| 305 | 2 | 5 | 5 | 5 |
| 320 | 3 | 5 | 5 | 5 |
| 352 | 4 | 5 | 5 | 5 |
| 404 | 5 | 5 | 5 | 5 |

Brightness scaled 1–5
5 = extremely bright, zero clouds
3 = semi bright
1 = dull all clouds There is a minimum temperature at which reflow generates a bright finish. Surprisingly, the reflow temperature at which the samples having the anti-tarnish coatings had a bright finish was below 265° C., which is substantially lower than the temperatures for a bright finish on Samples A and C. Control Sample A required a temperature of 405° C. and Sample C required a temperature in excess of 300° C. to achieve similar reflow brightening. A lower reflow temperature is beneficial because the reflow surface can be achieved in a furnace set at a particular temperature in less time. The article with the anti-tarnish agent does not have to be exposed to heat as long as articles without the anti-tarnish agent. This reduced time in a furnace increases efficiency of producing articles having a bright finish.

As a secondary benefit, at reflow temperatures between 300° C. and 350° C., Sample A exhibited significant yellowing. No yellowing at any temperature was detected in Sample B or Sample D at a temperature below 300° C.

While zinc, indium and phosphorous have been described as materials that reduce oxidation of tin, it should be appreciated that any element that has a more negative free energy of oxide formation than tin should also reduce the formation of oxide on a tin coating. Examples of such elements include potassium (K), sodium (Na), chromium (Cr), manganese (Mn), vanadium (V), boron (B), silicon (Si), thallium (Ti), cerium (Ce), magnesium (Mg), aluminum (Al) and calcium (Ca).

It is apparent that there has been provided in accordance with this invention a method for providing a tin coating that resists oxidation. While this invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A composite coating for a substrate, comprising:

(1) a first layer deposited onto said substrate, said first layer comprising tin or a tin-base alloy and having a thickness between 40 microinches and 400 microinches; and (2) an antitarnish layer deposited onto said first layer, said antitarnish layer having a thickness of between 5 Angstroms and 2000 Angstroms, said antitarnish layer made from a material selected from the group consisting of zinc, chromium, indium, phosphorous, potassium, sodium, manganese, vanadium, boron, silicon, thallium, cerium, magnesium, aluminum, calcium, and combinations thereof.

2. The composite coating of claim 1, further comprising an intermediate layer disposed between said substrate and said first layer.

3. The composite coating of claim 2, wherein said intermediate layer comprises an element selected from the group consisting of nickel, tin, iron, cobalt and copper, and alloys thereof.

4. The composite coating of claim 1, wherein said first layer further comprises a polymer component selected from the group consisting of polyimide, polyamide, polytetrafluoroethylene, and combinations thereof.

5. The composite coating of claim 1, wherein said first layer includes up to 50% by weight lead.

6. The composite coating of claim 1, wherein said antitarnish layer further comprises zinc chloride.

7. A composite coating for a substrate, comprising:

(1) a first layer deposited onto said substrate, said first layer having a first surface and a second surface, said second surface adjacent to said substrate, said first layer comprising tin and having a thickness between 40 microinches and 400 microinches; and (2) a concentration gradient of antitarnish agent infused into said first layer, said concentration gradient having the highest concentration of said antitarnish agent at said first surface.

8. The composite coating of claim 7, wherein said antitarnish agent is selected from the group consisting of zinc, chromium, indium, phosphorous, and combinations thereof.

9. The composite coating of claim 7, further comprising an intermediate layer disposed between said substrate and said first layer.

10. The composite coating of claim 9, wherein said intermediate layer comprises an element selected from the group consisting of nickel, tin, iron, cobalt and copper, and alloys thereof.

11. The composite coating of claim 7, wherein said first layer further comprises a polymer component selected from the group consisting of polyimide, polyamide, polytetrafluoroethylene, and combinations thereof.

12. The composite coating of claim 7, wherein said first layer includes up to 50% by weight lead.

13. The composite coating of claim 7, wherein said antitarnish agent further comprises zinc chloride.

14. A substrate coated with a composite coating, said substrate coated with said composite coating made by the steps of:

(1) depositing a first layer onto said substrate, said first layer comprising tin or a tin-base alloy and having a thickness between 40 microinches and 400 microinches; and (2) depositing an antitarnish layer onto said first layer, said antitarnish layer made from a material selected from the group consisting of zinc, chromium, indium, phosphorous, potassium, sodium, manganese, vanadium, boron, silicon, thallium, cerium, magnesium, aluminum, calcium, and combinations thereof, and having a thickness of between 5 Angstroms and 2000 Angstroms, to form a substrate coated with a composite coating.

15. The substrate coated with a composite coating of claim 14, further comprising depositing an intermediate layer between said substrate and said first layer.

16. The substrate coated with a composite coating of claim 15, wherein said intermediate layer comprises an element selected from the group consisting of nickel, tin, iron, cobalt and copper, and alloys thereof.

17. The substrate coated with a composite coating of claim 14, wherein said first layer further comprises a polymer component selected from the group consisting of polyimide, polyamide, polytetrafluoroethylene, and combinations thereof.

18. The substrate coated with a composite coating of claim 14, wherein said first layer includes up to 50% by weight lead.

19. The substrate coated with a composite coating of claim 14, wherein said antitarnish layer further comprises zinc chloride.

20. A substrate coated with a composite coating, said substrate coated with said composite coating made by the steps of:

(1) depositing a first layer onto said substrate, said first layer having a first surface and a second surface, said second surface adjacent to said substrate, said first layer comprising tin and having a thickness between 40 microinches and 400 microinches; and (2) infusing a concentration gradient of antitarnish agent into said first layer, said concentration gradient having the highest concentration of said antitarnish agent at said first surface, to form said substrate coated with said composite coating.

21. The substrate coated with said composite coating of claim 20, wherein said anti-tarnish agent is selected from the group consisting of zinc, chromium, indium, phosphorous, and combinations thereof.

22. The substrate coated with said composite coating of claim 20, further comprising depositing an intermediate layer between said substrate and said first layer.

23. The substrate coated with said composite coating of claim 22, wherein said intermediate layer comprises an element selected from the group consisting of nickel, tin, iron, cobalt and copper, and alloys thereof.

24. The substrate coated with said composite coating of claim 20, wherein said first layer further comprises a polymer component selected from the group consisting of polyimide, polyamide, polytetrafluoroethylene, and combinations thereof.

25. The substrate coated with said composite coating of claim 20, wherein said first layer includes up to 50% by weight lead.

26. The substrate coated with said composite coating of claim 20, wherein said antitarnish agent further comprises zinc chloride.

27. A composite coating for a substrate, comprising:

(1) a first layer deposited onto said substrate, said first layer comprising tin or a tin-base alloy and having a thickness between 40 microinches and 400 microinches, said first layer comprising up to 50% by weight lead and a polymer component selected from the group consisting of polyimide, polyamide, polytetrafluoroethylene, and combinations thereof; and (2) an antitarnish layer deposited onto said first layer, said antitarnish layer having a thickness of between 5 Angstroms and 2000 Angstroms, said antitarnish layer made from a material selected from the group consisting of zinc, chromium, indium, phosphorous, potassium, sodium, manganese, vanadium, boron, silicon, thallium, cerium, magnesium, aluminum, calcium, and combinations thereof.

28. A substrate coated with a composite coating, said substrate coated with said composite coating made by the steps of:

(1) depositing a first layer onto said substrate, said first layer comprising tin and a tin-base alloy and having a thickness between 40 microinches and 400 microinches, said first layer comprising up to 50% by weight lead and a polymer component selected from the group consisting of polyimide, polyamide, polytetrafluoroethylene, and combinations thereof; and (2) depositing an antitarnish layer onto said first layer, said antitarnish layer made from a material selected from the group consisting of zinc, chromium, indium, phosphorous, potassium, sodium, manganese, vanadium, boron, silicon, thallium, cerium, magnesium, aluminum, calcium, and combinations thereof, and having a thickness of between 5 Angstroms and 2000 Angstroms, to form a substrate coated with a composite coating.

* * * * *